US009850089B2

(12) United States Patent
Poisson et al.

(10) Patent No.: US 9,850,089 B2
(45) Date of Patent: Dec. 26, 2017

(54) APPARATUS AND METHOD FOR CONTROLLING THE UNWINDING OF A WEB

(71) Applicant: Kimberly-Clark Worldwide, Inc., Neenah, WI (US)

(72) Inventors: Phillip J. Poisson, Maple Grove, MN (US); Aaron Gander, Neenah, WI (US); Daniel K. Buck, Appleton, WI (US); Suzanne Laughrin, DePere, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/306,885

(22) PCT Filed: Jun. 20, 2014

(86) PCT No.: PCT/US2014/043343
§ 371 (c)(1),
(2) Date: Oct. 26, 2016

(87) PCT Pub. No.: WO2015/195132
PCT Pub. Date: Dec. 23, 2015

(65) Prior Publication Data
US 2017/0050815 A1 Feb. 23, 2017

(51) Int. Cl.
*B65H 23/32* (2006.01)
*B65H 23/035* (2006.01)
*B65H 23/02* (2006.01)

(52) U.S. Cl.
CPC ..... *B65H 23/035* (2013.01); *B65H 23/0204* (2013.01); *B65H 23/32* (2013.01);
(Continued)

(58) Field of Classification Search
CPC ... B65H 23/035; B65H 23/32; B65H 23/0204
See application file for complete search history.

(56) References Cited

U.S. PATENT DOCUMENTS 3,414,208 A 12/1968 Butler, Jr. et al.
3,679,116 A 7/1972 Hamlin et al.
(Continued)

FOREIGN PATENT DOCUMENTS

CN 101289020 A 10/2008
CN 101391508 A 3/2009
GB 1 295 536 A 11/1972

*Primary Examiner* — Sang Kim
(74) *Attorney, Agent, or Firm* — Kimberly-Clark Worldwide, Inc.

(57) ABSTRACT

An apparatus (1) for controlling the unwinding of a web (2) wound on a core is disclosed. The apparatus (1) includes a turnbar (10), an actuator (20), a sensor (30), and a controller (70). The turnbar (10) includes a target location to receive the web (2). The actuator (20) is coupled to the turnbar (10) and includes an axis of movement (29). The sensor (30) measures transverse placement of the web (2) relative to the target location and transmits an input signal to the controller (70) when transverse placement of the web (2) differs from the target location. The controller (70) provides an output signal to the actuator (20 to move the turnbar (10) along the axis of movement (29) such that the web (2) maintains substantial alignment with the target location.

18 Claims, 6 Drawing Sheets

(52) U.S. Cl.
CPC .. *B65H 2553/00* (2013.01); *B65H 2701/1315* (2013.01); *B65H 2801/57* (2013.01)

(56) References Cited

U.S. PATENT DOCUMENTS

| | | | | |
|---|---|---|---|---|
| 4,260,116 | A | 4/1981 | Collin | |
| 5,330,119 | A | 7/1994 | Rodriguez et al. | |
| 5,456,098 | A | 10/1995 | Hartwig et al. | |
| 5,482,225 | A | 1/1996 | Hartwig et al. | |
| 5,540,796 | A | 7/1996 | Fries | |
| 5,899,406 | A | 5/1999 | Payne | |
| 5,942,080 | A | 8/1999 | Mortellite et al. | |
| 5,957,402 | A | 9/1999 | McEathron et al. | |
| 6,086,011 | A | 7/2000 | Shibazaki et al. | |
| 6,533,217 | B2 | 3/2003 | Lind | |
| 6,595,465 | B2 | 7/2003 | Lamothe | |
| 6,682,063 | B2 | 1/2004 | Niedermeyer | |
| 6,735,933 | B2 | 5/2004 | Abba et al. | |
| 6,736,350 | B2 | 5/2004 | Lamothe | |
| 6,820,397 | B2 | 11/2004 | Haasl | |
| 7,328,568 | B2 | 2/2008 | Rahn | |
| 8,097,109 | B2 | 1/2012 | McNeil | |
| 8,316,766 | B2 * | 11/2012 | McLaughlin | B41J 15/165 101/227 |
| 2001/0032903 | A1 | 10/2001 | Durrance et al. | |
| 2005/0127125 | A1 * | 6/2005 | Young | B65H 23/038 226/19 |
| 2013/0063587 | A1 | 3/2013 | DeNoble et al. | |

* cited by examiner

APPARATUS AND METHOD FOR CONTROLLING THE UNWINDING OF A WEB

TECHNICAL FIELD

The present disclosure relates to an apparatus and method for controlling web alignment as a web is unwound from a roll.

BACKGROUND OF THE DISCLOSURE

During the manufacture of several goods, raw materials may be required that are provided in the form of webs 2 wound onto cores 3 in roll form. For example, a manufacturing process to produce absorbent articles, such as diapers, training pants, feminine hygiene absorbent articles, incontinence absorbent articles, etc., may include materials wound on rolls such as, for example, layers of the absorbent article, elastics and components of the absorbent core.

In general, webs 2 unwound from rolls may have web 2 alignment issues during the manufacturing process. Some causes of web 2 alignment issues can include the properties of the web 2 material or the manner in which the web 2 material is wound onto the core. For example, as some web 2 materials are unwound from the roll, the web 2 material properties may allow a tendency for the web 2 material to either neck or curl, and/or fold upon itself in the cross direction of the web 2. In other situations, the web 2 material may be wound on a roll in such a manner where transverse movement of the web 2 is inherent as the web 2 is unwound from the roll. For example, web 2 material unwound from a level-wound roll 1*b* must traverse the roll length 5 which introduces a large amount of web 2 weave during the manufacturing process. Additionally, some webs 2 may have the tendency to fold upon themselves in the cross direction of the web 2 when the web 2 encounters a change of direction in the web 2 path, such as a 90 degree turn. In some instances, the web 2 may encounter a twist that has been incorporated into the web 2 path as a means to turn the web 2 or to reduce web 2 weave. In prior systems, the web 2 may have been twisted with the use of a long dead bar and an idler, or non-rotating dead bar. Twists incorporated into the web 2 path for some web 2 materials can cause web 2 instability that may contribute to the web 2 folding over on itself. Web 2 foldover can also cause machine stops in order to correct the web 2 path. It can be understood by one skilled in the art that web 2 alignment or instability issues that arise early in the unwinding of the web 2 affect the web 2 alignment throughout the remainder of the process. The detection of web 2 alignment issues towards the end of the manufacturing process also allows for continuation of the web 2 alignment issues throughout the manufacturing process.

Web 2 alignment or instability issues can impact the quality of the finished product, aesthetically or functionally. Components of the finished product originating from webs 2 that experience web 2 alignment issues may not be placed in the desired location of the finished product. Web 2 alignment and instability issues can also cause waste and delay in the manufacturing process when the machine speed is reduced in order to control the web 2 material for desired splicing of one roll to another roll or for desired placement of the web 2 material in the finished product, for example, a cut and placed component of the absorbent core, such as a liquid distribution layer as is known to one skilled in the art. As such, a need remains to detect the web 2 alignment issues of webs 2 as they are unwound from a roll early in the manufacturing process. A further need remains to correct the web 2 alignment issues of webs 2 as quickly as possible in the manufacturing process. An additional need remains to eliminate the need to twist the web 2 in the manufacturing process.

SUMMARY OF THE DISCLOSURE

In an embodiment, an apparatus for controlling the unwinding of a web wound on a core forming a roll includes a turnbar. The roll includes a roll length. The turnbar may be configured to receive the web that is unwound from the core such that a portion of the web unwound from the core and disposed between the core and the turnbar provides an incoming web and a portion of the web after engaging the turnbar provides an outgoing web. The incoming web includes an incoming web axis and the outgoing web includes an outgoing web axis. The turnbar includes a target location to receive the incoming web. An actuator is coupled to the turnbar and the actuator includes an axis of movement substantially parallel to the outgoing web axis. A sensor is configured to measure a transverse placement of the web relative to the target location and the sensor being in electrical communication with the actuator through a controller. The sensor is configured to transmit an input signal to the controller when the transverse placement of the web differs from the target location. The controller is configured to provide an output signal to the actuator based on the input signal. The actuator is configured to receive the output signal from the controller and to move the turnbar along the axis of movement in response to the output signal such that the web maintains substantial alignment with the target location.

In another embodiment, an apparatus for controlling the unwinding of a web wound on a core forming a roll includes a turnbar, an actuator, a sensor, and a controller. The roll includes a roll length. The turnbar may be configured to receive the web unwound from the core such that a portion of the web unwound from the core and disposed between the core and the turnbar provides an incoming web and a portion of the web after contacting the turnbar provides an outgoing web. The incoming web includes an incoming web axis and the outgoing web includes an outgoing web axis. The turnbar includes an incoming web target location and an outgoing web target location. The sensor is configured to measure a transverse placement of the incoming web relative to the incoming web target location. The sensor is capable of transmitting an input signal to the controller when the transverse placement of the incoming web differs from the target location. The controller is configured to provide an output signal to the actuator based on the input signal. The actuator is coupled to the turnbar and is configured to receive the output signal from the controller. The actuator is configured to move the turnbar in response to the output signal such that the web maintains substantial alignment with the target location.

In a further embodiment, the present application includes a method for controlling the unwinding of a web wound on a core. The method includes providing a turnbar to receive the web unwound from the core, the turnbar having a target location. The turnbar is coupled to an actuator. The actuator includes an axis of movement that is substantially parallel to an axis of a portion of the web after the web contacts the turnbar. A sensor is provided to measure a transverse placement of the web relative to the target location. The sensor transmits a signal to the actuator based on measurements provided by the sensor when the transverse placement of the web differs from the target location. The actuator moves the turnbar along the axis of movement based on the signal received by the actuator such that the web is substantially aligned with the target location.

Figure 1C:
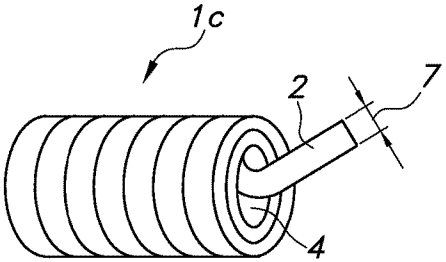
FIG. 1C representatively illustrates a perspective view of a roll of center-feed wound web material.

Repeat use of reference characters in the present specification and drawings is intended to represent the same or analogous features or elements of the disclosure.

DETAILED DESCRIPTION OF THE DISCLOSURE

Figure 1B:
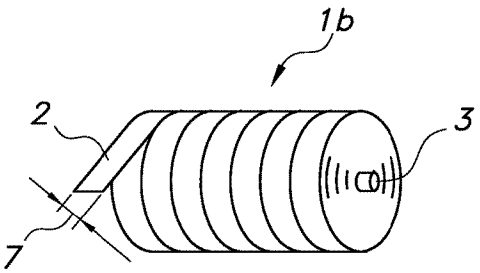
FIG. 1B representatively illustrates a perspective view of a roll of level-wound web material.
Figure 1A:
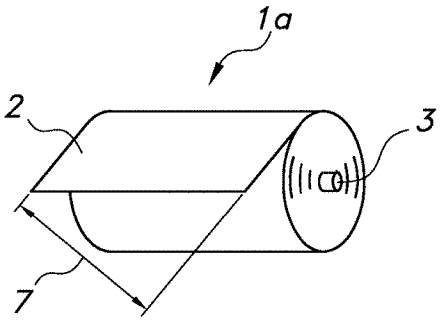
FIG. 1A representatively illustrates a perspective view of a regular roll of web material.
Figure 2:
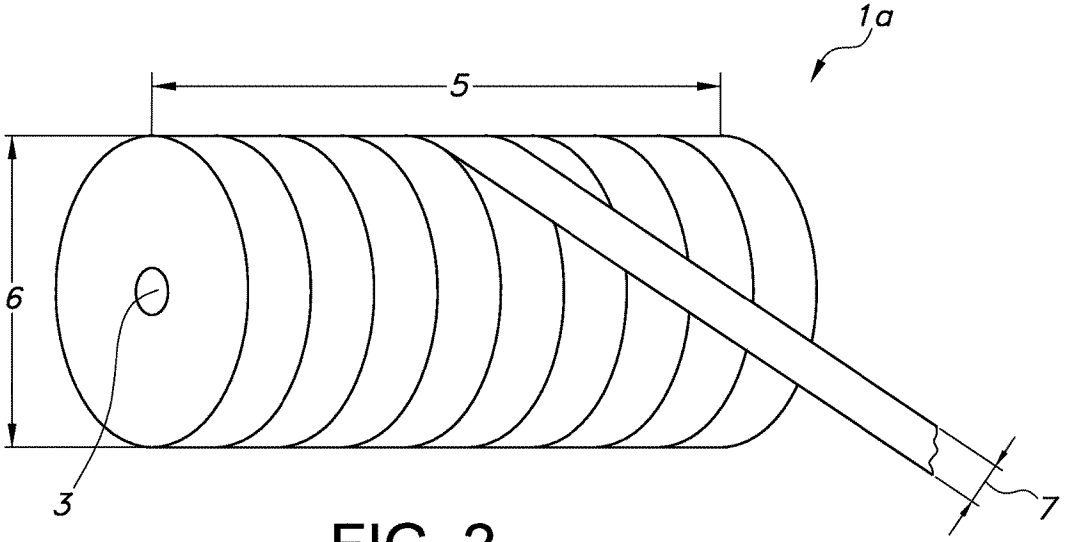
FIG. 2 representatively illustrates another perspective view of a roll of level-wound web material.

The present disclosure relates to an apparatus 1 and method for controlling the unwinding of a web 2 from a roll. The web 2 material may initially be wound onto a core 3 in a variety of different ways to form a roll wherein the roll includes a roll length 5 and a roll diameter 6. The roll length 5 as used herein refers to the length of the web 2 material along the length of the core 3 on which the web 2 material wound. It is possible that the length of the core 3 may be the same length as the roll length 5. In some instances, the length of the core 3 may be longer than the roll length 5; that is, a portion of the core 3 may extend beyond where the web 2 material is wound onto the core 3. The various roll winding configurations may change based on the end-use and/or shipping concerns. A regular roll 1*a* is illustrated in FIG. 1A. The regular roll 1*a* is formed by winding the web 2 material around a core 3 by turning the web 2 material over on itself several times. The web 2 is removed from the outside of the roll 1*a*. The web width 7 of a regular roll 1*a* is generally the same as the roll length 5. A level-wound roll 1*b* is illustrated in FIG. 1B. The level-wound roll 1*b* is formed by winding the web 2 material around a core 3 by traversing the web 2 material along the roll length 5 several times. The web 2 is removed from the outside of the roll 1*b*. The web width 7 is smaller than the roll length 5, and in most circumstances, substantially smaller than the roll length 5. As shown in FIG. 1*c*, a center-feed wound roll 1*c* is formed similarly to a level-wound roll 1*b* except that the core 3 is removed and the web 2 is removed, or fed, from a roll center 4. The web width 7 is smaller than the roll length 5 in a center-feed roll 1*c* similar to a level-wound roll 1*b* as well.

Webs 2 unwound from level-wound rolls 1*b* must traverse the entire roll length 5 such that the web 2 comes off of the roll 1*b* at different points along the roll length 5. The traversing motion along the roll length 5 of the level-wound roll 1*b* effectively creates a large amount of web 2 weave during the manufacturing process. For example, when the web 2 is being unwound from the ends of the level-wound roll 1*b*, the web 2 is entering the manufacturing process at a more extreme angle $\alpha$ than when the web 2 is being unwound from the middle of the level-wound roll 1*b*. The web 2 leaving the level-wound roll 1*b* at more extreme angles $\alpha$ can also lead the web 2 to flip or fold over on itself in the cross direction. Web 2 alignment issues may be exacerbated by other factors when the web 2 is unwound including high machine speeds and properties of the web 2 that may be non-symmetrical. For example, some webs 2 may have properties that vary between sides or surfaces of the web 2.

Web 2 materials that have a tendency to either neck or curl, and/or fold upon itself in the cross direction of the web 2 while being unwound from the roll may also contribute to web 2 alignment and instability issues, such as, for example, materials that include some amount of stretch or lack of recovery. Several materials used in manufacturing processes, such as, for example, those used to produce absorbent articles, may include materials that can contribute to web 2 alignment issues. Other examples of materials that can contribute to web 2 alignment issues are multi-layered, or composite, materials. Such materials may exhibit properties on a surface that differ from an opposite surface. For example, a material that can be used as a liquid acquisition/distribution layer in an absorbent article can be a two-layered, nonwoven fibrous composite, wherein the two layers are bonded through hydroentanglement and one surface is smooth and the opposite surface includes projections. Other examples include, but are not limited to, a single-layered fibrous nonwoven material wherein one surface is coated and the opposite surface is uncoated, a single-layered fibrous nonwoven material wherein one surface is coated and the opposite surface is coated with a different coating than the other surface, or a single-layered film nonwoven material wherein one surface is coated and the opposite surface is uncoated. Web 2 materials exemplary of those contributing to web 2 alignment issues may include, but are not limited to, plastic films and/or nonwoven webs that may be used as components in absorbent articles such as, for example, outer cover materials, urine or fecal matter acquisition or distribution materials, waist elastics, and leg elastics. Woven materials may also have a tendency to neck or curl, and/or fold upon itself in the cross direction of the web 2 while being unwound from the roll. Absorbent article refers herein to an article that may be placed against or in proximity to the body (i.e., contiguous with the body) of the wearer to absorb and contain various liquid and solid waste discharged from the body. Non-limiting examples of absorbent articles include personal care absorbent articles such as diapers, diaper pants, training pants, swimwear, absorbent underpants, adult incontinence products including garments and insert pads, bed pads, feminine hygiene pads or liners, digital tampons, sweat absorbing pads, shoe pads, helmet liners, wipes, tissues, towels, napkins, and the like, as well as medical absorbent articles such as medical absorbent garments, bandages, masks, wound dressings, surgical bandages and sponges, underpads, and the like.

Figure 3:
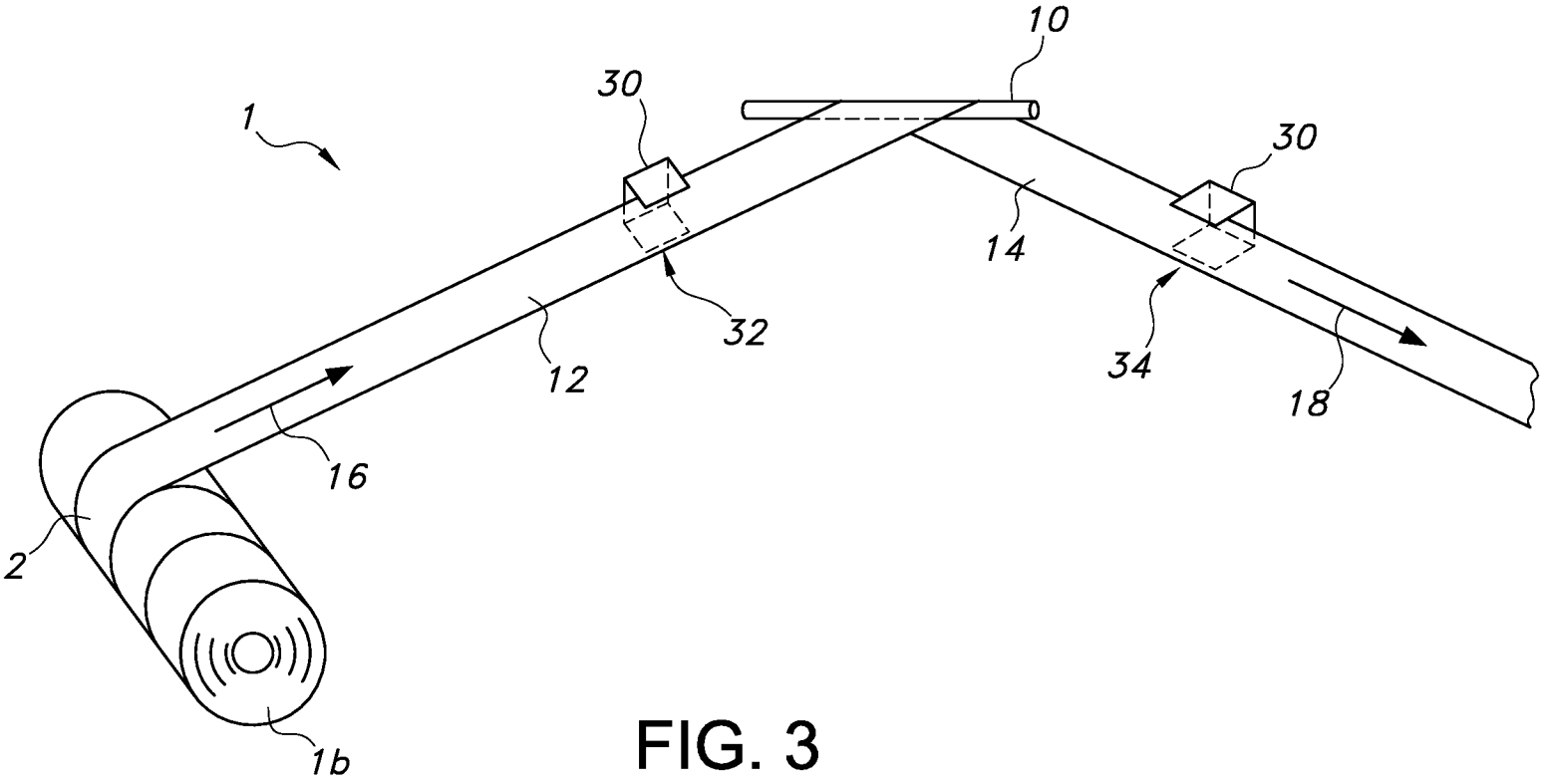
FIG. 3 representatively illustrates a perspective view of an exemplary apparatus of the present disclosure and process of utilizing the apparatus.
Figure 5:
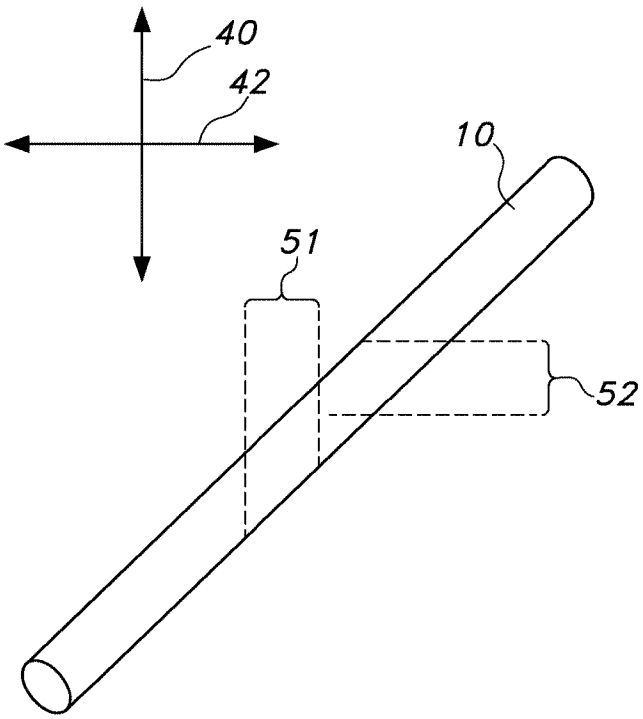
FIG. 5 representatively illustrates a top plan view of an incoming web target location and an outgoing web target location on a turnbar of the present disclosure.
Figure 4:
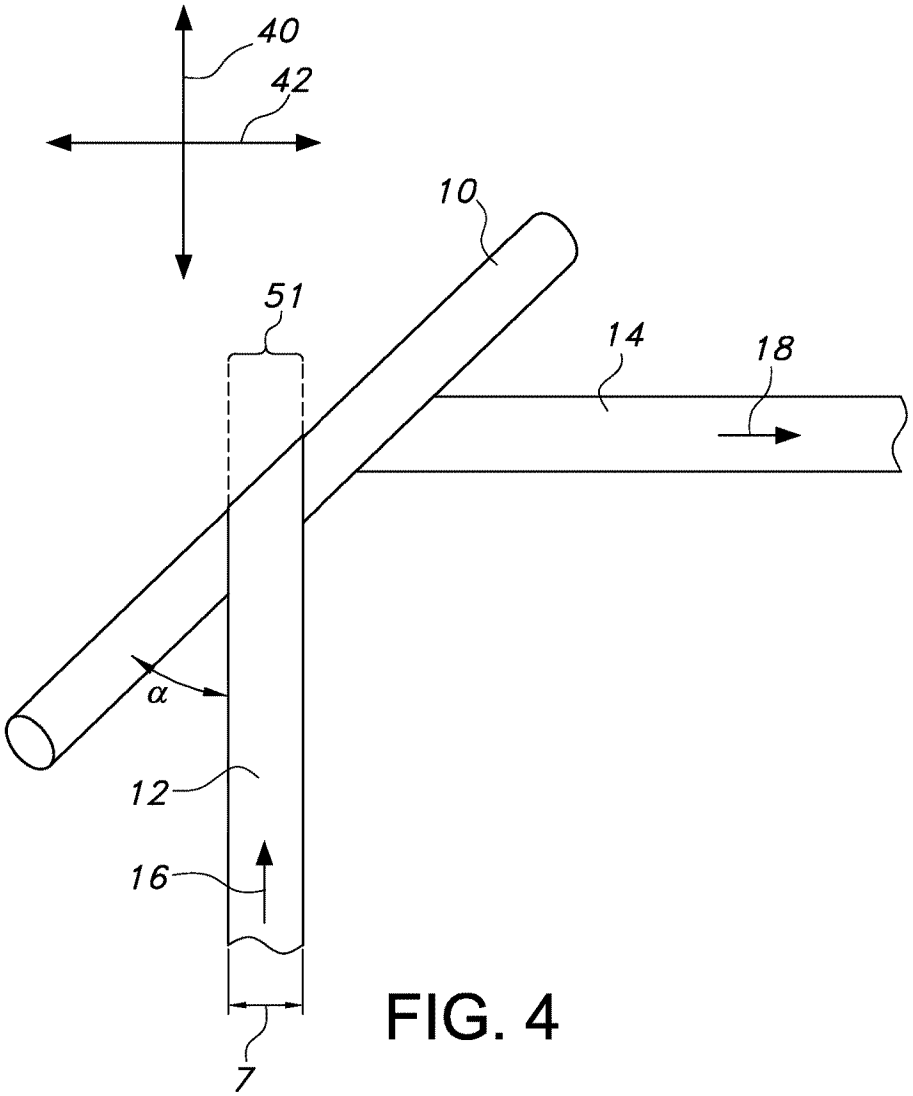
FIG. 4 representatively illustrates a top plan view of a web being received by the turnbar at an incoming web target location and thus leaving the turnbar at the outgoing web target location.

The present disclosure provides an apparatus 1 and a method to control web 2 alignment issues that may arise when unwinding a web 2 from a roll. With reference to FIGS. 3-5, in an embodiment, the web 2 is unwound from a level-wound roll 1*b* as illustrated in FIG. 3 however, the apparatus 1 and method described herein can be utilized with other forms of rolls, such as those previously discussed. The apparatus 1 includes a turnbar 10, a sensor 30 and an actuator 20 (not shown in FIG. 3 for the purpose of clarity). The turnbar 10 receives an incoming web 12 that is the portion of the web 2 that is unwound from the core 3 and disposed between the core 3 and the turnbar 10. An outgoing web 14 is the portion of the web 2 after engagement with the turnbar 10. The incoming web 12 includes an incoming web axis 16 that can be substantially parallel to the longitudinal direction 40 and the outgoing web 14 includes an outgoing web axis 18 that can be substantially parallel to the lateral direction 42 as illustrated in FIG. 4. Turnbars 10 are used in the web 2 path to change the direction of the web 2 during the manufacturing process. Turnbars 10 can be placed at an angle $\alpha$ relative to the incoming web axis 16 that is parallel to the longitudinal direction 40. Often times, the turnbar 10 is placed at a 45 degree angle $\alpha$ in order to turn the incoming web 12 such that the outgoing web axis 18 is approximately 90 degrees from, or substantially perpendicular to, the incoming web axis 16. The exemplary embodiment and configuration of the turnbar 10 shown and discussed herein forms a 90 degree turn of the web 2 wherein the incoming web axis 16 is substantially perpendicular to the outgoing web axis 18. However, the apparatus 1 and method can apply to turnbars 10 configured to provide other angles $\alpha$ between the incoming web axis 16 and the outgoing web axis 18. It can be appreciated that the turnbar 10 may be placed at any angle $\alpha$ to provide a desirable turn in the web 2 path for the given manufacturing process, for example from 1 degree to 89 degrees, and more specifically from about 10 degrees to about 80 degrees. The turnbar 10 has a target location that includes an incoming web target location 51 and an outgoing web target location 52 as illustrated in FIG. 4 and FIG. 5. The turnbar 10 receives the incoming web 12 at the target location 51 as illustrated in FIG. 4. The incoming web target location 51 of the turnbar 10 will in turn include an outgoing web target location 52 also illustrated in FIG. 5. The outgoing web target location 52 is the location on the turnbar 10 where the outgoing web 14 should engage the turnbar 10 if the incoming web 12 engages the turnbar 10 at the incoming web target location 51. While the incoming web target location 51 and the outgoing web target location 52 are shown in FIG. 4 and FIG. 5 as zones that correspond to the web width 7, the target location could be configured to be a point or a width that is less than, equal to, or several times greater than the web width 7. The target location may be as small or as large as desired as long as it serves as a reference location with respect to the web 2. The turnbar 10 may be made from materials that have low friction and to reduce drag of the web 2, such as polished steel or a coating and/or the turnbar 10 may include air assistance, but is not limited to such configurations.

Figure 6:
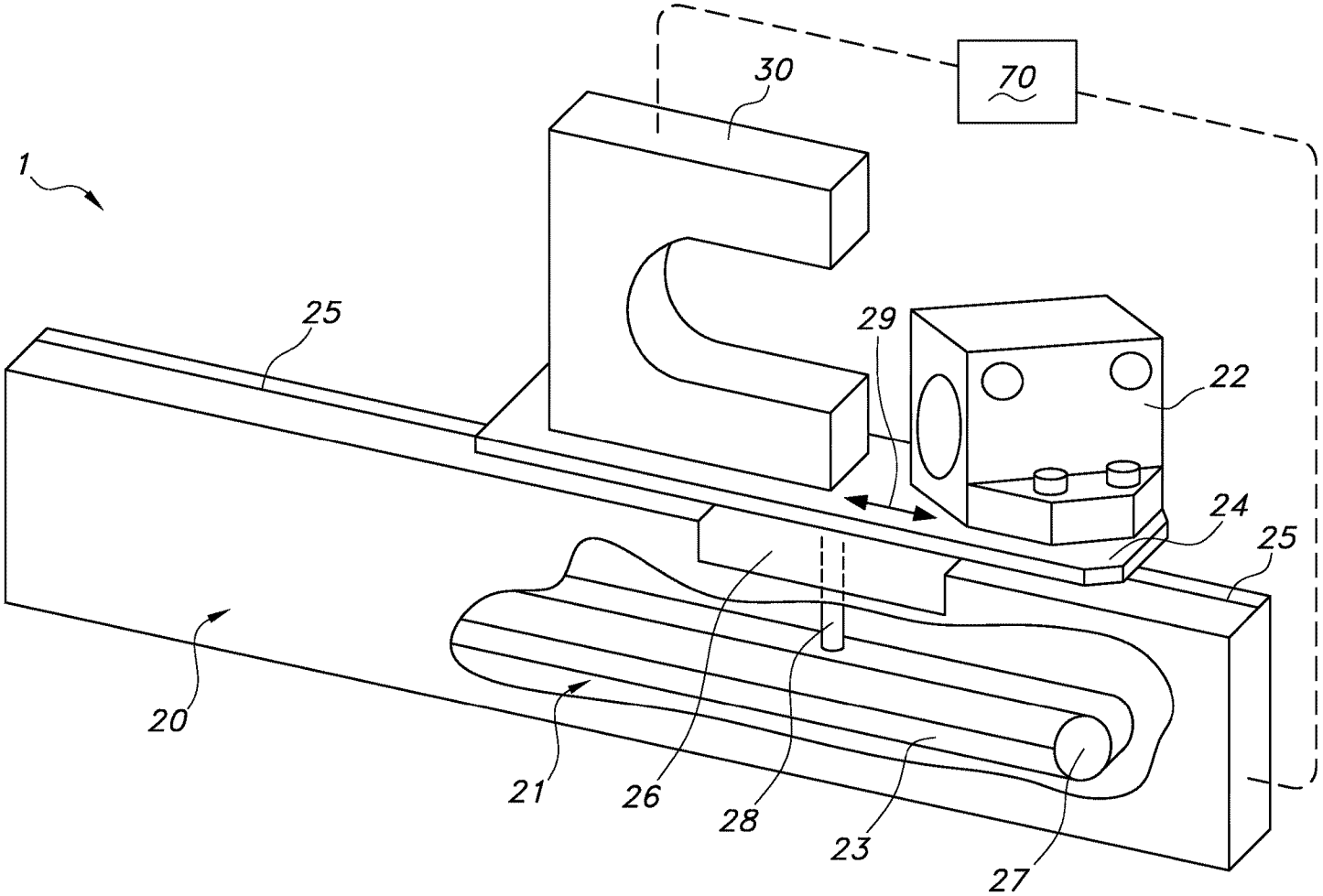
FIG. 6 representatively illustrates a perspective view of a preferred embodiment of the apparatus of the present disclosure, the turnbar being removed for clarity.
Figure 7:
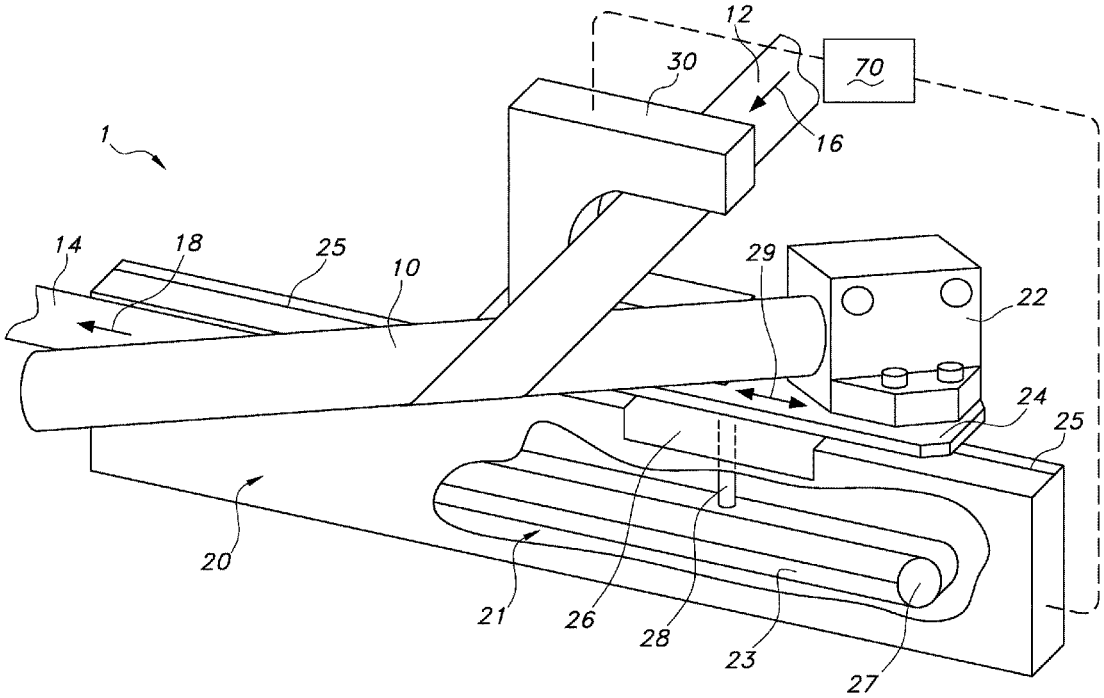
FIG. 7 representatively illustrates another perspective view of the preferred embodiment of the apparatus of the present disclosure.

The apparatus 1 further includes an actuator 20, as illustrated in FIGS. 6 and 7. The actuator 20 includes a drive mechanism 21 that is positioned internally of the actuator 20. The drive mechanism 21 can provide movement to a component, such as for example, a carriage 26 that may be coupled to the actuator 20. The drive mechanism 21 may include a motor and some means to communicate this movement to the carriage 26. For example, a cut-away portion of a belt drive mechanism 21 is illustrated in FIGS. 6 and 7 wherein a belt 23 is shown over a belt roller 27 (all components of the belt drive mechanism 21 are not shown for the purpose of clarity), where the belt 23 can be coupled to the carriage 26 via a carriage connector 28, such that linear movement of the belt 23 can provide linear movement to the carriage 26.

The carriage 26 may be moveably coupled to the actuator 20 as illustrated in FIGS. 6 and 7. The actuator may include a carriage guide 25 upon which the carriage 26 can move along, such as, for example through a sliding movement. A mounting plate 24 may also be coupled to the carriage 26. A turnbar mount 22 may be coupled to the mounting plate 24 wherein the turnbar 10 can be coupled to the turnbar mount 22.

Figure 8:
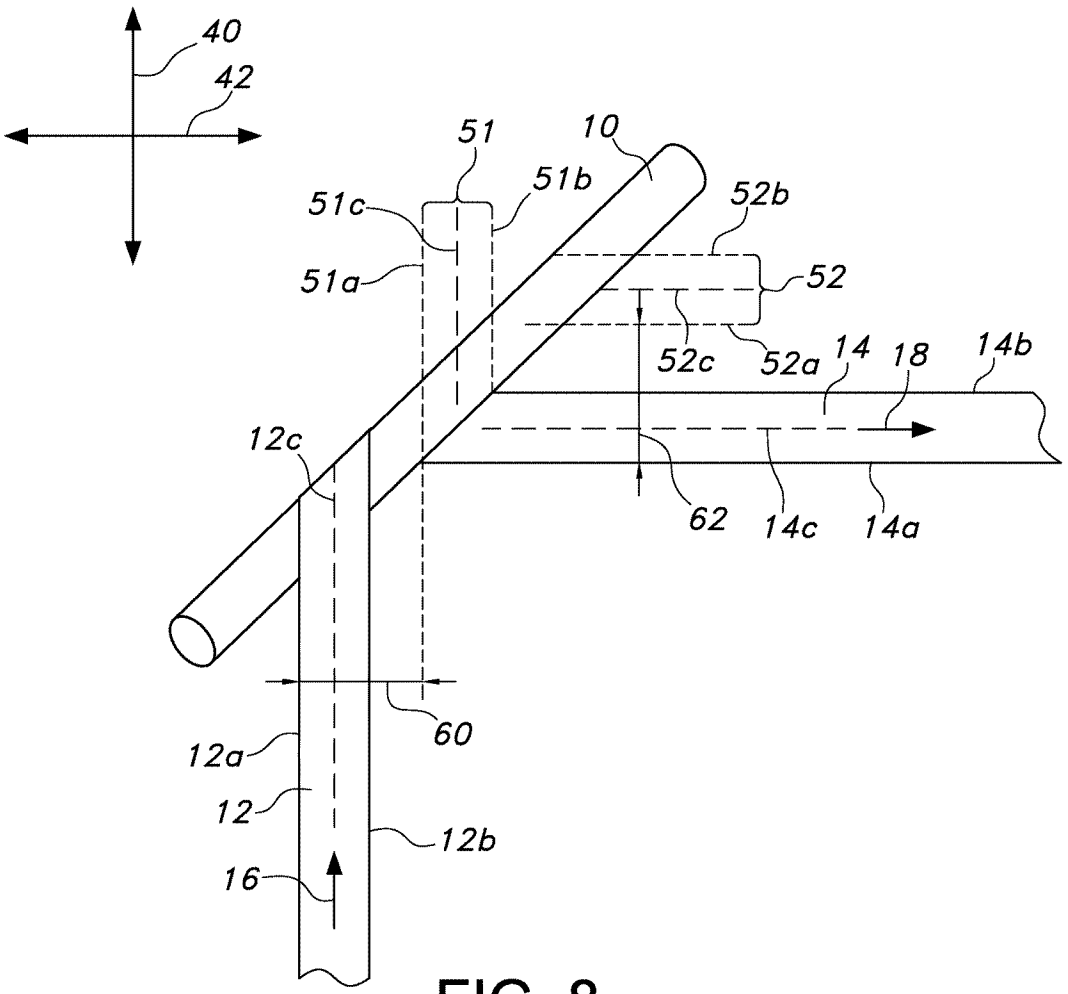
FIG. 8 representatively illustrates a top plan view of a web being received by the turnbar that is not in alignment with the incoming web target location and thus does not leave the turnbar at the outgoing web target location.

The sensor 30 of apparatus 1 is in electrical communication with the actuator 20 and can be configured to measure transverse movement of, 1) the incoming web 12 relative to the incoming web target location 51, or 2) the outgoing web 14 relative to the outgoing web target location 52. For example, an incoming web target location difference 60 can be detected when there is a difference between where the incoming web 12 engages the turnbar 10 relative to the incoming web target location 51. With respect to the sensor 30 detecting the incoming web target location difference 60, the incoming web 12 includes an incoming web left edge 12*a* and an incoming web right edge 12*b* and the incoming web target location 51 includes an incoming web target location left edge 51*a* and an incoming web target location right edge 51*b*. The sensor 30 can, for example, detect the incoming web target location difference 60 when the incoming web left edge 12*a* is not in alignment with the incoming web target location left edge 51*a*, or when the incoming web right edge 12*b* is not in alignment with the incoming web target location right edge 51*b*. In such a circumstance, the sensor 30 can be referred to as an edge sensor. The transverse movement of the incoming web 12 may be to the incoming target left side 51*a* or to the incoming target right side 51*b* as shown in FIG. 8. The transverse movement of the incoming web 12 is substantially parallel to the lateral direction 42 as illustrated in FIGS. 4, 5 and 8.

Alternatively, the sensor 30 can detect an outgoing web target location difference 62 wherein the outgoing web 14 includes an outgoing web bottom edge 14*a* and an outgoing web top edge 14*b* and the outgoing web target location 52 includes an outgoing web target location target bottom edge 52*a* and an outgoing web target location top edge 52*b*. The outgoing web target location difference 62 can be detected when there is a difference between where the outgoing web 14 engages the turnbar 10 relative to the outgoing web target location 52 such that the transverse movement of the outgoing web 14 may above the outgoing web target location top side 52*b* or below the outgoing web target location bottom side 52*a* as also shown in FIG. 8. The transverse movement of the outgoing web 14 is substantially parallel to the longitudinal direction 40 as illustrated in FIGS. 4, 5 and 8.

Another type of sensor 30 may detect an incoming web centerline 12*c* relative to some reference, such as for example an incoming web target location centerline 51*c* wherein the incoming web centerline 12*c* and the incoming web target location centerline 51*c* are collinear with the incoming web axis 16. The sensor 30 can detect the incoming web target location difference 60 when the incoming web centerline 12*c* is not in alignment with the incoming web target location centerline 51*c*. Alternatively, the sensor 30 may detect an outgoing web centerline 14*c* relative to some reference, such as for example an outgoing web target location centerline 52*c* wherein the outgoing web centerline 14*c* and the outgoing web target location centerline 52*c* are collinear with the outgoing web axis 18. The sensor 30 can detect the outgoing web target location difference 62 when the outgoing web centerline 14*c* is not in alignment with the outgoing web target location centerline 52*c*. The transverse movement of the incoming web 12 in the lateral direction 42 directly affects the transverse movement of the outgoing web 14 in the longitudinal direction 40, wherein the incoming web axis 16 is substantially parallel to the longitudinal direction 40 and the outgoing web axis 18 is substantially parallel to the lateral direction 42 as illustrated in FIG. 4, FIG. 5 and FIG. 8.

In one embodiment, the actuator 20 of apparatus 1 is an electronic device that can provide linear movement in an axis of movement 29 such that the axis of movement 29 is substantially parallel to the outgoing web axis 18 as illustrated in FIG. 7. The actuator 20 is configured to receive the signal from the sensor 30 wherein the turnbar 10 is moved to keep the incoming web 12 substantially in alignment with the incoming web target location 51, and/or the outgoing web 14 substantially in alignment with the outgoing web target location 52. The actuator 20 of apparatus 1 may include a rotary motion type actuator 20 that can be also be used for linear applications by transforming the rotary motion to linear motion with the use of, for example, screw, cam, rack, chain or belt mechanisms. Alternatively, some actuators 20 provide direct linear movement, such as, for example, piezoelectric, linear motor, or moving coil actuators. An exemplary actuator 20 of apparatus 1 includes a belt driven actuator available from Tolomatic, Hamel, Minn., USA, model B3W15/M3W15. It should be understood that the actuator 20 could provide any type of movement, such as for example, rotary; although, linear movement is discussed as one way of having the actuator 20 respond to the sensor 30 signal. Additionally, the actuator 20 can move in more than one linear direction. For example, it is contemplated that the actuator 20 can provide motion in a direction parallel to the outgoing web axis 18 and/or the incoming web axis 16.

Exemplary actuators 20 that may be used when unwinding level-wound rolls 1*b* should be able to provide suitable stroke lengths that are related to the roll length 5. In embodiments configured for use with level-wound rolls 1*b*, 1) the actuator 20 should be able to at least traverse the entire roll lengths as the incoming web 12 engages the turnbar 10 and 2) the actuator 20 may also provide stroke lengths greater than the roll length 5 to allow for detection of the incoming web target location difference 60 or the outgoing web target location difference 62 that may occur at each end of the roll length 5 for the level-wound roll 1*b*. For example, the stroke length of actuators 20 used in the manufacturing process of absorbent articles may include lengths of from about 120 mm to about 1500 mm and more specifically from about 600 mm to about 900 mm. While stroke lengths in a typical application for manufacturing absorbent articles have been discussed, it should be understood that stroke lengths outside of this range may exist for other applications. Exemplary actuators 20 will also be able to move at speeds that accommodate the speed of the incoming web 12 relative to the roll diameter 6; that is, the speed of the actuator 20 will be less when the level-wound roll 1*b* is at full roll diameter 6 and the actuator 20 speed increases as the incoming web 12 is unwound from the roll 1*b* and approaches the core 3.

The sensor 30 and the actuator 20 can be in electrical communication with one another by being in electrical communication with software that is housed in a controller 70. The controller 70 can be a programmable logic controller (PLC) and/or may be housed in a computer or central processing unit (CPU). The actuator 20 is configured to move the turnbar 10 based on output signals received from the controller 70. The signal sent from the controller 70 to the actuator 20 is defined by feedback control that is based on input information received by the controller 70 from the sensor 30 via input signals from the sensor 30. The feedback control may calculate an error value, or the difference between a measured variable and a desired setpoint, such as, for example, the incoming web target location difference 60 or the outgoing web target location difference 62. The sensor 30 sends the error value to the controller 70 wherein the controller 70 attempts to minimize the error value by sending an appropriate output signal to the actuator 20 to actuate movement of the actuator 20, and in turn, the turnbar 10. Some examples of feedback control include, but are not limited to, proportional, proportional-integral (PI), or proportional-integral-derivative (PID).

In an embodiment, as illustrated in FIG. 7, the sensor 30 may detect the incoming web target location difference 60. The sensor 30 transmits a signal to the controller 70 and if necessary, the controller 70 provides a signal to the actuator 20 to change the position of the turnbar 10. The actuator 20 can cause the turnbar 10 to move by enacting the drive mechanism 21 to slide the carriage 26 along the carriage guide 25 in the direction of the axis of movement 29. The movement of the carriage 26 in turn moves the mounting plate 24 upon which the turnbar 10 is attached via the turnbar mount 22.

In an embodiment, the sensor 30 can be located along the path of the web 2 at a location 1) prior to the turnbar 10 to sense the incoming web 12 such as at the incoming web sensor location 32, or 2) after the turnbar 10 to sense the outgoing web 14 such as at the outgoing web sensor location 34 as illustrated in FIG. 3. In another embodiment, the sensor 30 can be coupled to the actuator 20 to sense the outgoing web 14. In yet another embodiment, that is preferred, the sensor 30 is coupled to the actuator 20 to sense the incoming web 12 as illustrated in FIG. 6 and FIG. 7. The apparatus 1 configuration of this embodiment provides a series of benefits including, 1) early detection of the incoming web target location difference 60, 2) quicker correction of web 2 alignment or instability issues based on the incoming web target location difference 60 before web 2 alignment issues are translated further downstream, 3) reduced likelihood of the web 2 material folding on itself or twisting, 4) reduced machine downtime, 5) reduced number of processing steps, such as for example, eliminating the need for steps to twist the web 2, 6) reduced machine stops, 7) increased product quality, and 8) reduced waste.

In an embodiment, a method for controlling the unwinding of a web 2 wound on a core 3 includes providing a turnbar 10 to receive an incoming web 12 at an incoming web target location 51. The turnbar 10 can be coupled to an actuator 20 wherein the actuator 20 includes an axis of movement 29 that is substantially parallel to the outgoing web axis 18 as shown in FIGS. 6 and 7. A sensor 30 is provided to measure the incoming web location difference 60 or the outgoing web location difference 62. The sensor 30 transmits a signal to the actuator 20 through the use of a controller 70 when the incoming web location difference 60 or the outgoing web location difference 62 differs from the incoming web target location 51 or the outgoing web target location 52, respectively. The actuator 20 moves the turnbar 10 along the axis of movement 29 based on the signal received from the controller 70 based on the sensor 30 such that the incoming web 12 is substantially aligned with the incoming web target location 51. The sensor 30 can be coupled to the actuator 20 as shown in FIGS. 6 and 7. A benefit of such a configuration allows the sensor 30 to move transversely with the turnbar 10, and thus, the incoming web 12. In such a configuration, the sensor 30 may not need to be as wide as in a configuration where the sensor 30 is not coupled to the actuator 20. For example, in a configuration where the sensor 30 is not coupled to the actuator 20, as shown in FIG. 3, the sensor 30 may have to be very wide, such as for example, greater than the roll length 5, in order to detect the incoming web target location difference 60 or the outgoing web target location difference 62 which may cause greater transverse movement of the turnbar 10 for correction of the web 2 alignment.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention

What is claimed is:

1. An apparatus for controlling the unwinding of a web wound on a core forming a roll having a roll length comprising:

a turnbar configured to receive the web unwound from the core such that a portion of the web unwound from the core and disposed between the core and the turnbar provides an incoming web and a portion of the web after engaging the turnbar provides an outgoing web, the incoming web including an incoming web axis and the outgoing web including an outgoing web axis;

the turnbar having a target location to receive the incoming web;

an actuator coupled to the turnbar;

the actuator having an axis of movement being substantially parallel to the outgoing web axis; and a sensor configured to measure a transverse placement of the web relative to the target location and being in electrical communication with the actuator through a controller;

the sensor configured to transmit an input signal to the controller when the transverse placement of the web differs from the target location;

the sensor coupled to the actuator such that the sensor moves with the turnbar;

the controller configured to provide an output signal to the actuator based on the input signal; and the actuator configured to receive the output signal from the controller and to move the turnbar along the axis of movement in response to the output signal such that the web maintains substantial alignment with the target location.

2. The apparatus of claim 1 wherein the turnbar is placed at a 45 degree angle with respect to the incoming web axis and the axis of movement is substantially perpendicular to the incoming web axis.

3. The apparatus of claim 1 wherein the actuator is a linear actuator.

4. The apparatus of claim 1 wherein the actuator includes a stroke length from 120 mm to 1500 mm.

5. The apparatus of claim 1 wherein the actuator includes a stroke length that is equal to or greater than the roll length.

6. The apparatus of claim 1 wherein the target location includes an incoming web target location and the sensor detects the transverse placement of the web relative to the incoming web target location by measuring the incoming web.

7. The apparatus of claim 1 wherein the target location includes an outgoing web target location and the sensor detects the transverse placement of the web relative to the outgoing web target location by measuring the outgoing web.

8. The apparatus of claim 1 wherein the web is level-wound on the core.

9. An apparatus for controlling the unwinding of a web that is wound on a core forming a roll having a roll length comprising:

a turnbar;

an actuator;

a sensor; and a controller;

wherein the turnbar is configured to receive the web unwound from the core such that a portion of the web unwound from the core and disposed between the core and the turnbar provides an incoming web and a portion of the web after contacting the turnbar provides an outgoing web, the incoming web including an incoming web axis and the outgoing web including an outgoing web axis, the turnbar having an incoming web target location and an outgoing web target location;

wherein the sensor is configured to measure a transverse placement of the incoming web relative to the incoming web target location and the sensor is capable of transmitting an input signal to the controller when the transverse placement of the incoming web differs from the incoming web target location;

wherein the controller is configured to provide an output signal to the actuator based on the input signal; and wherein the actuator is coupled to the turnbar and is configured to receive the output signal from the controller and is configured to move the turnbar in response to the output signal such that the web maintains substantial alignment with the incoming web target location.

10. The apparatus of claim 9 wherein an axis of movement of the actuator is substantially parallel to the outgoing web axis.

11. The apparatus of claim 9 wherein an axis of movement of the actuator is substantially perpendicular to the outgoing web axis.

12. The apparatus of claim 9 wherein the sensor is coupled to the actuator such that the sensor moves with the turnbar.

13. The apparatus of claim 9 wherein the sensor is an edge sensor.

14. A method for controlling the unwinding of a web wound on a core comprising:

providing a turnbar to receive the web unwound from the core, the turnbar having a target location;

coupling the turnbar to an actuator, the actuator having an axis of movement that is substantially parallel to an axis of a portion of the web after the web contacts the turnbar;

providing a sensor to measure a transverse placement of the web relative to the target location;

transmitting a signal to the actuator based on measurements provided by the sensor when the transverse placement of the web differs from the target location; and moving the turnbar along the axis of movement based on the signal received by the actuator such that the web is substantially aligned with the target location wherein the sensor is coupled to the actuator such that the sensor moves with the turnbar.

15. The method of claim 14 wherein the turnbar is placed at a 45 degree angle with respect to the incoming web axis and the axis of movement is substantially perpendicular to the incoming web axis.

16. The method of claim 14 wherein the actuator is a linear actuator.

17. The method of claim 14 wherein the linear actuator includes a stroke length from 120 mm to 1500 mm.

18. The method of claim 14 wherein the actuator includes a stroke length that is equal to or greater than the roll length.

* * * * *